US008192184B2

(12) United States Patent
Hiltemann

(10) Patent No.: US 8,192,184 B2
(45) Date of Patent: Jun. 5, 2012

(54) PUMP WITH A CYLINDRICAL COOLING BUSH

(75) Inventor: Ulrich Hiltemann, Wermelskirchen (DE)

(73) Assignee: ixetic Hueckeswagen GmbH, Hueckeswagen (DE)

( * ) Notice: Subject to any disclaimer, the term of this patent is extended or adjusted under 35 U.S.C. 154(b) by 744 days.

(21) Appl. No.: 12/084,533

(22) PCT Filed: Oct. 20, 2006

(86) PCT No.: PCT/DE2006/001852

§ 371 (c)(1),
(2), (4) Date: Mar. 23, 2009

(87) PCT Pub. No.: WO2007/054057

PCT Pub. Date: May 18, 2007

(65) Prior Publication Data

US 2009/0226337 A1 Sep. 10, 2009

(30) Foreign Application Priority Data

Nov. 9, 2005 (DE) ..... 10 2005 053 456

(51) Int. Cl.
*F04B 35/00* (2006.01)

(52) U.S. Cl. ..... 418/83; 418/86

(58) Field of Classification Search ..... 417/83–101; 418/83–86; 123/572–574
See application file for complete search history.

(56) References Cited

U.S. PATENT DOCUMENTS

| | | | | |
|---|---|---|---|---|
| 2,938,468 | A * | 5/1960 | Kececioglu et al. | 417/354 |
| 3,193,190 | A * | 7/1965 | Lindberg | 418/86 |
| 3,291,221 | A * | 12/1966 | Kovats | 416/157 R |
| 3,374,943 | A | 3/1968 | Cervenka | |
| 3,950,116 | A * | 4/1976 | Sharples | 418/83 |
| 4,255,098 | A * | 3/1981 | Hertell | 418/76 |
| 4,760,833 | A * | 8/1988 | Tatyrek | 123/574 |
| 2001/0031214 | A1 * | 10/2001 | Haavik | 418/85 |

FOREIGN PATENT DOCUMENTS

| | | |
|---|---|---|
| DE | 103 07 813 A1 | 9/2004 |
| JP | 03 258989 | 11/1991 |

* cited by examiner

*Primary Examiner* — M. McMahon
(74) *Attorney, Agent, or Firm* — Davidson, Davidson & Kappel, LLC

(57) ABSTRACT

A pump, particularly to a vane-cell pump for a vacuum for brake boosters in motor vehicles or for drawing blow-by gas out of the crankcase of internal combustion engines, with a casing, a rotor and with at least one vane and a liquid cooling device, which is depicted by a simple, essentially cylindrical insertion bush for inserting inside the casing.

21 Claims, 2 Drawing Sheets

PUMP WITH A CYLINDRICAL COOLING BUSH

The present invention relates to a pump, in particular to a vane-type pump for a vacuum for brake power assist units in motor vehicles or for evacuating blow-by gas from the crankcase of combustion engines, having a housing, a rotor and at least one vane and one liquid-cooling device.

BACKGROUND

Under the related art, vacuum pumps powered directly by the combustion engine are operated as wet-running pumps. Engine oil is used for lubrication, sealing and cooling. When dry-running pumps are used, one encounters the problem of dissipating the heat generated by friction and compression, especially at high speeds.

Also known from the related art are pumps, commonly referred to as scroll compressors, for example, which have costly cooling devices on the housing that require a large installation volume.

SUMMARY OF THE INVENTION

An object of the present invention is to provide a pump which will overcome these disadvantages.

The present invention provides a pump, in particular a vane-type pump for generating a vacuum for brake power assist units in motor vehicles or for evacuating blow-by gas from the crankcase of combustion engines, having a housing, a rotor and at least one vane and one liquid-cooling device, the cooling device including a simple, essentially cylindrical insert bushing that is placed inside of the housing. A pump is preferred where the insert bushing may form both a bearing bushing for the vane and the rotor, as well as one of the walls of the cooling device.

A pump is also preferred where the insert bushing may have a helicoidal groove in its outer circumferential surface that, together with the inner circumferential surface of the housing, forms a cooling channel. Here, the advantage may be derived that the cooling channels are able to be produced by a simple external machining of the bushing, while the smooth inner circumferential surface does not require any machining.

A pump according to the present invention may have the distinguishing feature that the insert bushing is manufactured in one piece of a material having good bearing surface/sliding properties, in particular low wear and low friction properties, for the vane and the rotor. This has the advantage that the insert bushing, not, however, the remaining housing of the pump, is to be manufactured of a high-grade material.

A pump is also preferred where the housing may be made of a flange part, an essentially tubular intermediate part and an end cover part. Here the advantage is derived that, through the use of two tubular parts, namely that of the housing and that of the insert bushing, a simple design may be employed to produce the cooling device.

In addition, a pump is preferred where the cooling fluid or the lubricating oil of the combustion engine may be used as coolant.

A pump is also preferred where the pump, as what is commonly referred to as a dry-running pump, for example, without lubricating oil, may be combined with a wet-running vacuum pump, for example, a pump that is lubricated and cooled with lubricating oil.

A pump according to the present invention may have the distinguishing feature that the insert bushing may have made from plastic. This has the advantage that the helicoidal cooling channels configured externally on the bushing may be produced as already preformed channels in the plastic injection molding process.

A pump is also preferred where the vane may be made of plastic, optionally including caps fabricated from a low-wear, low-friction plastic. In addition, a pump is preferred in which the rotor may be made of plastic.

Another pump according to the present invention may have the distinguishing feature that the housing may be manufactured from a metallic material, for example of sheet steel or of die-cast aluminum.

BRIEF DESCRIPTION OF THE DRAWINGS

The present invention is described in the following with reference to the figures.

DETAILED DESCRIPTION

Figure 1:
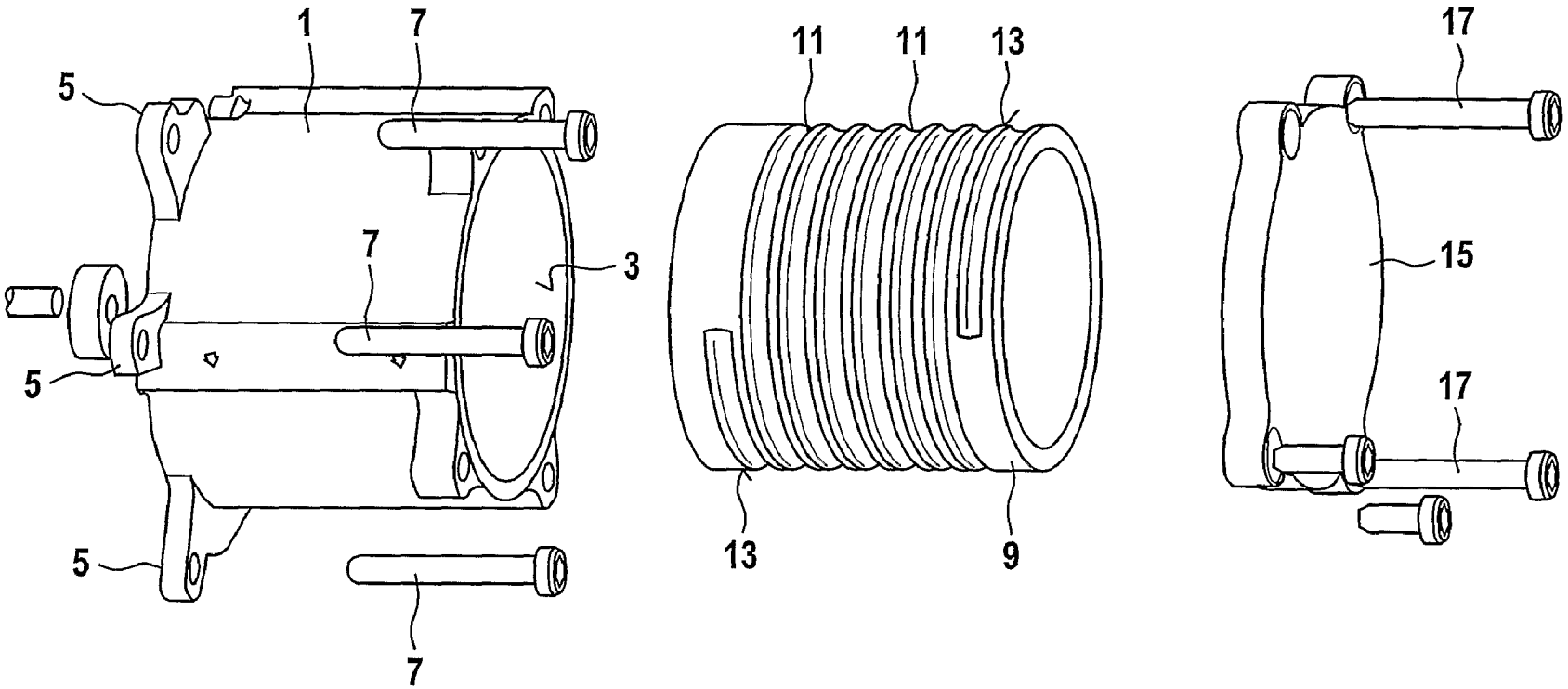
FIG. 1 shows the insert bushing and the housing parts of a pump according to the present invention.

The individual parts of the housing and the bushing-shaped insert of the cooling device are shown in FIG. 1. An approximately cylindrical or cup-shaped housing 1 that is produced from a metallic material such as die-cast aluminum, for example, has a smooth, cylindrical inner circumferential surface 3. However, housing 1 may equally be made of a sheet steel material, for example, in a deep-drawing process, or of a plastic material. In addition, housing 1 has a flange side having mounting lugs 5 and may be flange-mounted on this side onto a wet-running vacuum pump according to the related art, using screws 7, for example. An insert bushing 9, which has helicoidal grooves 11 in its cylindrical outer surface, is inserted into housing 1. Once insert bushing 9 is inserted into housing 1, outer circumferential surface 13 of insert bushing 9 hermetically seals off insert bushing 9 against cylindrical inner surface 3 of housing 1, so that only helicoidal grooves 11 within the now double-walled housing form a circumferentially extending channel. Through this channel, a suitable coolant may be externally introduced, for example, from the cooling-water circuit of the combustion engine or the lubricating-oil circuit of the combustion engine. Within insert bushing 9, a rotor, which is eccentrically mounted relative to the housing and, for example, a vane disposed within a slot therein, are rotationally driven via a drive shaft or a coupling device. The now double-walled housing is sealed by an end cover 15 that is tightened by corresponding screws 17 against housing 1 and against insert bushing 9. In this context, insert bushing 9 is preferably made of a high-grade, wear-resistant material having good sliding properties, since the vane slides by way of its end caps sealingly along the inner wall of bushing 9 within the same. A high-grade plastic is preferably selected for insert bushing 9 that is low-wear and also has good sliding properties and, moreover, is able to efficiently seal against inner wall 3 of housing 1 because of a certain elasticity relative to metallic materials.

Figure 2:
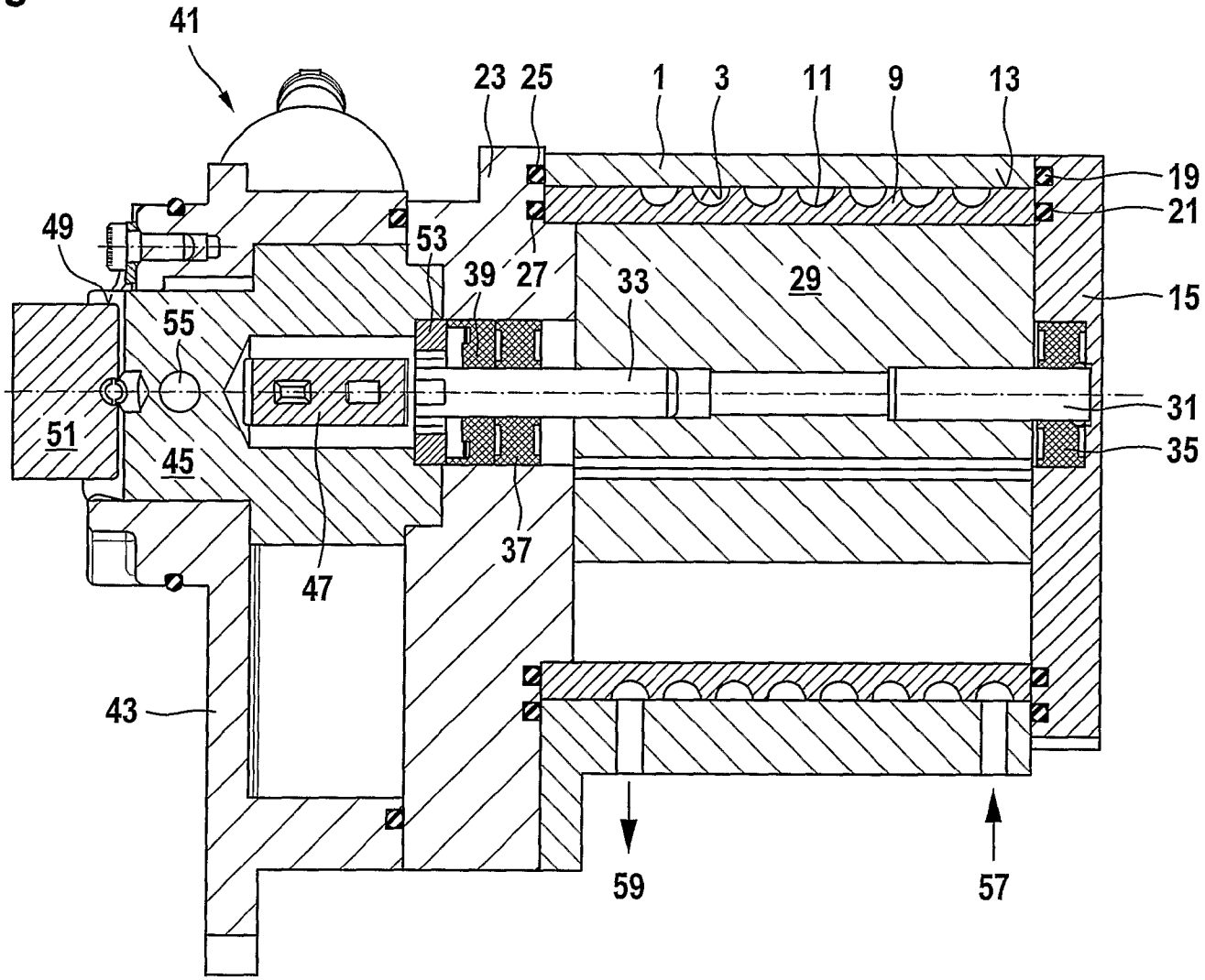
FIG. 2 shows a cross section through a combination of a dry-running pump according to the present invention and a wet-running vacuum pump.

The pump according to the present invention is shown in FIG. 2 in combination with what is generally known as a wet-running vacuum pump. The same components are denoted here by the same reference numerals as in FIG. 1. Discernible in cross section is housing 1 having inner wall 3 into which insert bushing 9 having helicoidal grooves 11 is inserted. By its surface 13, insert bushing 9 seals against housing 1 having inner surface 3. Housing 1 and insert bushing 9 are laterally sealed by cover 15. In addition, seals 19 and 21 are disposed between cover 15, housing 1 and insert bushing 9, respectively. On the other side, the liquid-cooled vacuum pump is sealed by a flange 23, which has seals 25 oriented toward housing 1 and seals 27 oriented toward the insert bushing. A rotor 29 shown in cross section and having two drive shaft ends 31 and 33 is eccentrically mounted within insert bushing 9. Shaft ends 31 and 33 are supported, in turn, in two bearings 35 and 37, bearing 35 being mounted in a recess of cover 15 and bearing 37 in flange 23. In addition, the liquid-cooled vacuum pump is sealed by a shaft seal 39 against wet-running vacuum pump 41. In this context, flange 23 forms the transition to wet-running vacuum pump 41 and, thus, at the same time constitutes part of the housing of this vacuum pump 41. In addition, vacuum pump 41 includes a housing 43 and a rotor 45. A vane 47 is discernible in cross section within rotor 45. Rotor 45 is driven via a driving surface 49 and a coupling 51 by a drive, for example the shaft end of a camshaft projecting out of the combustion engine. On the side opposing coupling 51, rotor 45 has a second coupling device 53 which constitutes the drive for shaft portion 33 of the liquid-cooled vacuum pump. While wet-running pump 41 is lubricated and cooled via lubricating-oil supply devices, represented here partially in cross section by channels 55, this does not apply to the liquid-cooled vacuum pump. Therefore, to cool the dry-running vacuum pump, a coolant flow is introduced through an inlet 57 into helicoidal ring channels 11, and the coolant flow is subsequently directed, in turn, through a corresponding outlet 59 into the other coolant circuit of the motor vehicle. Thus, the liquid cooling makes it possible for the heat that is generated in response to rotation of the dry-running vacuum pump to be dissipated, thereby preventing the pump from overheating. In this context, one area of application for the dry-running vacuum pump may be the evacuation of blow-by gas out of the crankcase space of the combustion engine. However, as an individual liquid-cooled pump, the vacuum pump may be used in the manner of the wet-running vacuum pump for brake power assist systems, if, for some other reasons, it is not feasible for oil to be supplied from the lubricating-oil circuit of the combustion engine.

LIST OF REFERENCE NUMERALS

1 cup-shaped housing
3 cylindrical inner circumferential surface
5 mounting lugs
7 screws
9 insert bushing
11 helicoidal grooves
13 outer circumferential surface of insert bushing 9
15 end cover
17 screws
19 seal for housing
21 seal for insert bushing
23 flange
25 seal on housing
27 seal on insert bushing
29 rotor
31 drive shaft end
33 drive shaft end
35 bearing in cover 15
37 bearing in flange 23
39 shaft seal
41 wet-running vacuum pump
43 housing of vacuum pump 41
45 rotor of vacuum pump 41
47 vane of vacuum pump 41
49 drive surface of rotor 45
51 coupling
53 second coupling device
55 lubricating-oil channels
57 inlet for coolant flow
59 outlet for coolant flow

What is claimed is:

1. A pump comprising:
a housing including an inner circumferential surface;
a rotor;
at least one vane; and
one liquid-cooling device, the cooling device including a cylindrical insert bushing having an outer circumferential surface placed inside the housing, the outer circumferential surface-of the insert bushing and the inner circumferential surface of the housing forming a cooling channel sealed from the rotor.

2. The pump as recited in claim 1 wherein the pump is a vane type pump for generating a vacuum for brake power assisted units in motor vehicles.

3. The pump as recited in claim 1 wherein the pump is a vane type pump for evacuating blow-by gas from a crankcase of a combustion engine.

4. The pump as recited in claim 1 wherein the insert bushing forms a bearing bushing for the vane and the rotor and for one of the walls of the cooling device.

5. The pump as recited in claim 1 wherein the outer circumferential surface-of the insert bushing has a helicoidal groove, the helicoidal groove and the inner circumferential surface of the housing forming the cooling channel.

6. The pump as recited in claim 1 wherein the insert bushing is one piece of a material, the insert bushing having a reduced wearing and friction bearing surface for the vane and the rotor.

7. The pump as recited in claim 1 wherein the housing has a flange part, a tubular intermediate part and an end cover part.

8. The pump as recited in claim 3 wherein the combustion engine has a cooling fluid or a lubricating oil as a coolant.

9. The pump as recited in claim 8 wherein the pump connects with a wet-running vacuum pump.

10. The pump as recited in claim 9 wherein the pump is a dry running pump.

11. The pump as recited in claim 9 wherein the wet-running vacuum pump is lubricated and cooled with the lubricating oil.

12. The pump as recited in claim 1 wherein the insert bushing is made of plastic.

13. The pump as recited in claim 1 wherein the vane is made of plastic.

14. The pump as recited in claim 1 wherein the rotor is made of plastic.

15. The pump as recited in claim 1 wherein the housing is a metallic material.

16. The pump as recited in claim 15 wherein the metallic material is a sheet of steel.

17. The pump as recited in claim 15 wherein the metallic material is a sheet of die cast aluminum.

18. A motor vehicle comprising:
a combustion engine having a crankcase; and
a pump as recited in claim 1 for evacuating blow-by gas from the crankcase.

19. A motor vehicle compromising:
a brake power assist unit; and
a pump as recited in claim 1 for generating a vacuum in the brake power assist unit.

20. The pump as recited in claim 13 wherein the vane includes low-wear, low-friction plastic caps.

21. A pump comprising:

a housing;

a rotor;

at least one vane; and one liquid-cooling device, the cooling device including a cylindrical insert bushing placed inside the housing;

wherein an outer circumferential surface-of the insert bushing has a helicoidal groove, the helicoidal groove and an inner circumferential surface of the housing forming a cooling channel.

* * * * *